United States Patent [19]

Kelly

[11] Patent Number: 4,688,564

[45] Date of Patent: Aug. 25, 1987

[54] SECURITY DEVICE FOR YOUNG CHILDREN

[76] Inventor: Alison O. Kelly, 3643 Mosswood Dr., Lafayette, Calif. 94549

[21] Appl. No.: 898,791

[22] Filed: Aug. 18, 1986

Related U.S. Application Data

[63] Continuation of Ser. No. 622,210, Jun. 19, 1984, abandoned.

[51] Int. Cl.[4] ..... A61F 13/00

[52] U.S. Cl. ..... 128/133

[58] Field of Search ..... 128/132, 133, DIG. 15; 119/96

[56] References Cited

U.S. PATENT DOCUMENTS

| | | | |
|---|---|---|---|
| 2,994,300 | 7/1958 | Grahling | 119/96 |
| 4,414,969 | 11/1983 | Heyman | 128/133 |
| 4,422,455 | 12/1983 | Olsen | 128/DIG. 15 |
| 4,521,922 | 6/1985 | Mitchell | 2/170 |

*Primary Examiner*—John D. Yasko

*Attorney, Agent, or Firm*—Schapp and Hatch

[57] ABSTRACT

A child security tethering device is disclosed wherein the wristlets worn by the child and the mother or other custodian are formed from non-rigid material, the linking member linking these wristlets is formed from elastically elongatable material, the wristlets are locked about the wrists of the child and the mother or other custodian by means of Velcro material, and a loop is provided to render the disengagement of the Velcro material members of the child's wristlet relatively difficult.

1 Claim, 4 Drawing Figures

SECURITY DEVICE FOR YOUNG CHILDREN

This is a continuation of co-pending application Ser. No. 06/622,210 filed on June 19, 1984 now abandoned.

BACKGROUND OF THE INVENTION

1. Field of the Invention

My invention relates to security devices for young children, and more particularly to tethering means for tethering young children to their mothers or other guardians.

2. Description of the Prior Art

Various harnessing means whereby parents or other guardians can maintain restrictive control over very young children, especially those who have only recently learned to walk, have for a long time been well known in the art.

Such prior art child harness means, however, have been provided with a hand-held loop adapted to be grasped by the mother or guardian, and thus have encumbered one hand of the mother or guardian.

Further, such prior art child harness devices have in general been secured to the child by a body harness the application of which to the child is onerous and time consuming.

Yet further, the linking members of such prior art child harnessing devices, i.e., the members adapted to extend between the child and the mother or guardian, are in general flaccid, single-strand members, which are both subject to becoming entangled with persons and objects and at the same time present very little resistance to cutting.

Wrist-to-wrist tethering devices, such as police handcuffs, are also well known. However, such devices are in general obviously not well adapted for use in tethering children to their mothers or other guardians. Police handcuffs, for example, are characterized by very short, non-extensible linking members, and by wristlets which can be removed only by means of a suitable key or the like, and thus are not easily and quickly removed from the wrist for convenience or in case of emergency. Further, it is generally found in police handcuffs that neither wristlet is made more difficult to remove than the other.

SUMMARY OF THE INVENTION

Accordingly, it is an object of my present invention to provide security tethering means for young children comprising wristlets which are light and easily applied by the mother or other guardian, which wristlets are interlinked by linking members which are elastically extensible to provide a limited range of freedom for the child while avoiding entanglement with persons or objects, and at the same time are characterized by a desired degree of resistance to cutting.

Another object of my invention is to provide security tethering devices for young children in which the wristlet of the mother or other guardian can be very rapidly and easily removed, for convenience or in an emergency, and yet at the same time the wristlet for the child, which is easily applied, is difficult for the child to remove.

Yet another object of my invention is to provide security tethering means for young children which are comprised almost entirely of non-rigid materials, and thus provide minimum discomfort for the users.

A further object of my invention is to provide security tethering means for young children which are readily and inexpensively fabricated from known materials and components.

Other objects of my invention will in part be obvious and in part will appear hereinafter.

My invention, accordingly, comprises the apparatus embodying features of construction, combinations of elements, and arrangements of parts exemplified in the following disclosure, and the scope of my invention will be indicated in the appended claims.

In accordance with a principal feature of my invention, wrist-to-wrist tethering means for tethering young children to their mothers or other guardians, are provided which comprise "soft wristlets", i.e., wristlets which are fabricated in large part from non-rigid materials.

In accordance with another principal feature of my invention, the linking members of such wrist to-wrist tethering means are fabricated from elastically extensible, multi-strand cord or cable materials.

In accordance with yet another principal feature of my invention, said cord or cable materials are selected not only for their elastic extensibility but also for their relatively high resistance to complete severance by cutting.

In accordance with an additional principal feature of my invention, the wristlets of the child security tethering means thereof are fabricated from webbing or strapping and are adapted to be secured around the wrists, respectively, of the child and the mother or other guardian by means of pilate fasteners of the type now well known under the trademark "Velcro". (See U.S. Pat. No. 2,717,437.)

In accordance with yet another principal feature of my invention, the child's wristlet of the security tethering devices of certain embodiments of my invention, as distinct from the mother's wristlet, comprises an additional strap or loop extending over the so-called loop part of the Velcro wristlet fastener, whereby loosening or removal of the child's wristlet is rendered difficult for the child.

For a fuller understanding of the nature and objects of my invention, reference should be had to the following detailed description, taken in connection with the accompanying drawing.

DESCRIPTION OF THE PREFERRED EMBODIMENTS

Figure 1:
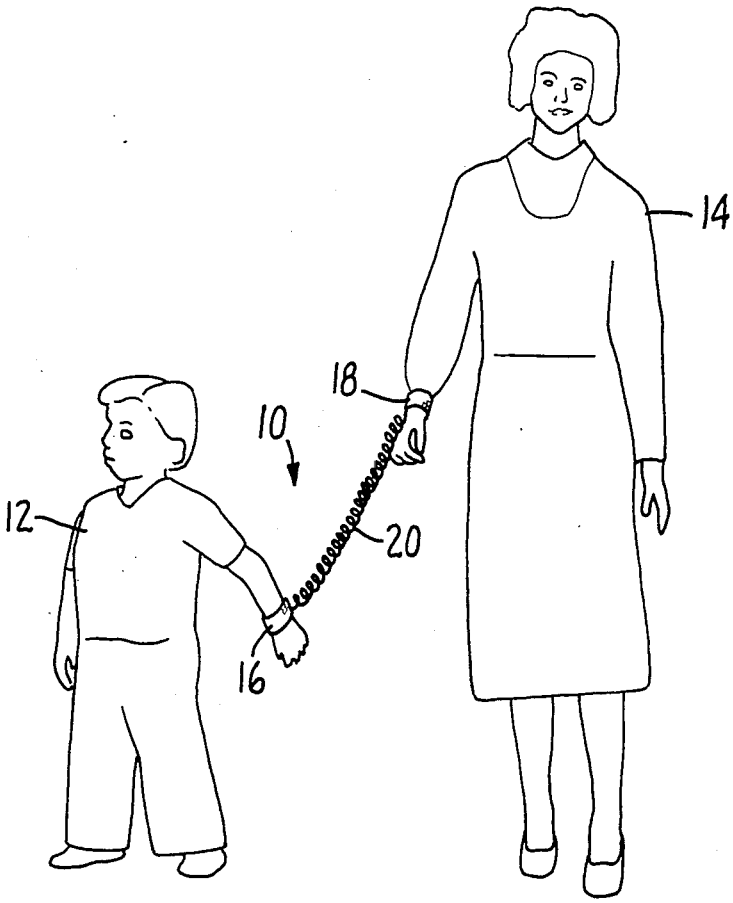
FIG. 1 is a pictorial view of a child tethered to its mother by means of a security tethering device of my invention.

Referring now to FIG. 1, there is shown a child security tethering device 10 of my invention by means of which a child 12 is secured to his mother 14.

As further seen in FIG. 1, child security tethering device 10 comprises a child's wristlet 16 which is secured to the child 12 and an adult's wristlet 18, which is secured to a wrist of the mother 14; the two wristlets 16, 18 being interconnected by means of a helical, elastically extensible linking member 20.

Figure 2:
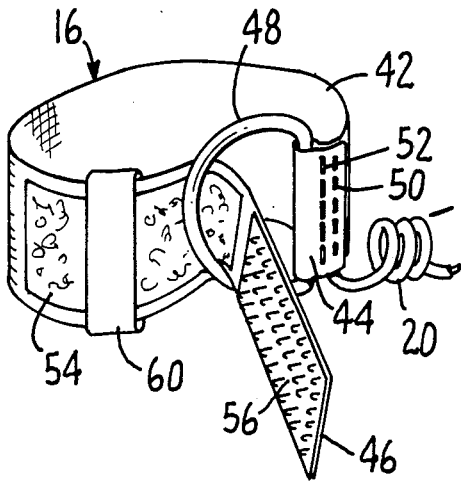
FIG. 2 is a perspective view (partly in phantom) of a child security device of my invention.

Referring now to FIG. 2, the child security tethering device 10 of FIG. 1 is shown in detail.

As shown in FIG. 2, adult wristlet or custodian wristlet 18 is comprised of a band 22 of woven fabric material. The woven fabric material of band 22 may be comprised of natural or synthetic fibers or a mixture of them, and may be cut from a continuous ribbon of such material.

In the well-known manner, the outer end 24 of band 22 is turned back upon itself and stitched, or otherwise treated, to prevent fraying.

Figure 4:
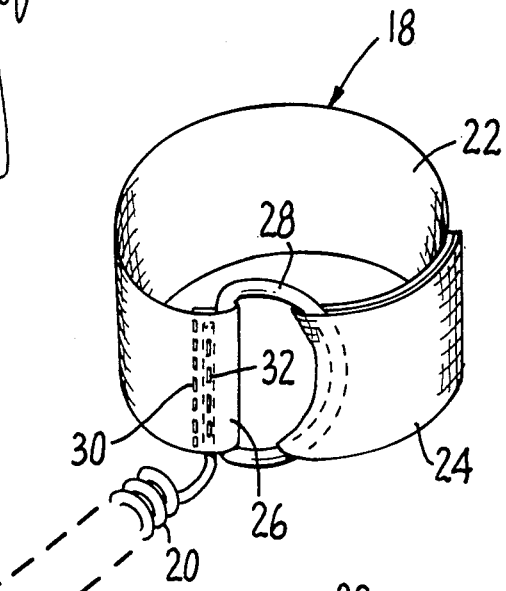
FIG. 4 is a sectional view of the child security tethering device of FIG. 2, taken on line 4—4 of FIG. 3.
Figure 4:
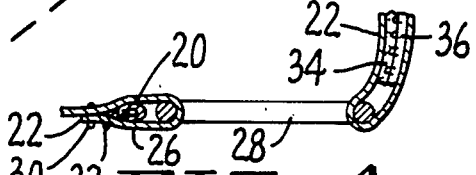
Figure 3:
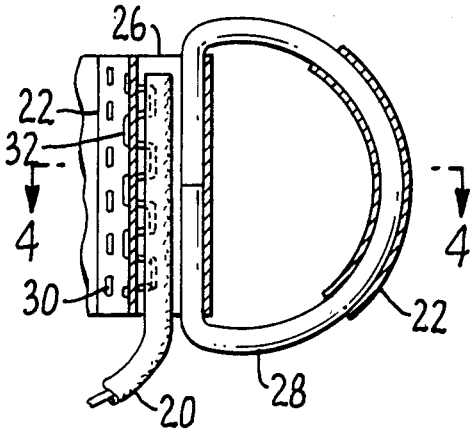
FIG. 3 is a partial view, partially in section and partially in phantom, of the child security tethering device of FIG. 2.

As best seen in FIGS. 3 and 4, the inner end 26 of band 22 is passed around the rectilinear portion of a "D" ring 28, and also around one end portion of linking member 20.

After being passed around "D" ring 28 and one end of linking member 20, the extremity of end portion 26 is brought into contact with the main body portion of band 22 and sewn thereto by means of stitching 30.

A separate row of stitching 32 is provided which, as best seen in FIG. 3, passes through the end portion 26 of band 22 and also at least partially passes through said end portion of linking member 20, thereby firmly securing linking member 20 to wristlet 18.

Other modes and patterns of stitching or otherwise securing the outer end portion 26 of band 22 to "D" ring 28 and an end portion of linking member 20 will occur to those having ordinary skill in the art without the exercise of invention, and all such embodiments so fabricated fall within the embrace of my invention.

In certain preferred embodiments of my invention linking member 20 may be a suitable length of helical telephone handset cord of well known type. It is to be understood, however, that in other preferred embodiments of my invention linking member 20 may be a suitable length of plastic-coated multi-strand flexible steel cable of the kind used in locking bicycles to stationary objects. Other suitable elastically extensible coiled materials for use as the linking member 20 in certain embodiments of my invention will be selected by those having ordinary skill in the art without the exercise of invention, and lie within the embrace of my invention.

It is also to be noted that my invention is not limited to the employment of a "D" shaped joining ring, such as the illustrated joining ring 28, but rather also embraces embodiments in which the joining ring 28 is generally rectangular in shape, or of any other shape found suitable by those having ordinary skill in the art. It is also to be noted that joining ring 28, while formed from brass in one preferred embodiment, may be formed from other metallic materials, or from materials of the kind sometimes called "plastic", or from combinations of materials or composite materials.

Referring again to FIG. 4, it will be seen that two portions of Velcro material 34, 36 are affixed respectively to the same face of band 22, spaced a short distance from each other. Thus, in the well-known manner, the outer end of band 22 can be secured to "D" ring 28 by passing the portion of it bearing Velcro material portion 36 through "D" ring 28, bringing Velcro material portion 36 into juxtaposition with Velcro material portion 34 and pressing the two Velcro material portions together, as illustrated in FIG. 4.

Thus, it will be understood by those having ordinary skill in the art, informed by the present disclosure, that by the above construction, which is illustrative only and not limitative of my invention, mother 14 may secure wristlet 18 to her wrist by simply passing band 22 around her wrist, passing open end 24 through "D" ring 28, juxtaposing Velcro material portions 34 and 36, and pressing Velcro material portions 34 and 36 together. As will also be evident to those having ordinary skill in the art, one of said Velcro material portions 34, 36 will be a hook pile portion, while the other will be a loop pile portion.

As will also be apparent to those having ordinary skill in the art, informed by the present disclosure, one end of linking member 20 will be securely fastened to band 22, although the manner of so securing linking member 20 to band 22 is not limitative of my invention.

Referring again to FIG. 2, and comparing wristlet 16 as there shown with wristlet 18 as there shown, it will be seen by those having ordinary skill in the art, informed by the present disclosure, that wristlet 16 is substantially like wristlet 18, except for the length of band 42, which is reduced in proportion to the difference between the average child's wrist size and the average adult's wrist size.

Similarly, "D" ring 48 is analogous in structure and function to "D" ring 28, and Velcro material portions 54 and 56 are analogous in structure and function to Velcro portions 34 and 36.

Further, outer end portion 44 of band 42 is analogous in structure and function to outer end portion 24 of band 22, and thus is passed around the rectilinear portion of "D" ring 48 and the end portion of linking member 20 remote from adult's wristlet 18. Similarly, the extremity of open end 44 of band 42 is sewn to the main body of band 42 by means of stitching 50, and stitching 52 is provided to secure one end of linking member 20 to band 42.

Thus, it will be seen by those having ordinary skill in the art informed by the present disclosure that except for accomodation to child's wrist size, wristlet 16 substantially differs from wristlet 18 only in the provision of a fabric loop 16 which overlies Velcro material portion 54. As is well known in the application of Velcro fasteners to other devices for children, the cooperating end 46 of band 42, bearing hook pile Velcro portion 56, can be passed through loop 60 by slightly transversly flexing end portion 46, but at the same time the loop 60 renders it difficult for small children to disengage Velcro portions 54 and 56, because they pull upward on open end 46 (to the right of loop 60 as shown in FIG. 2). Thus, by the provision of loop 60 which is secured to the inner face of band 42 remote from Velcro portion 54, the engagement between Velcro portions 54 and 56 is made relatively "childproof", and wristlet 16 is secured to the wrist of child 12 in "childproof" manner.

It will thus be seen that the objects set forth above, among those made apparent in the preceding description, are efficiently attained, and since certain changes may be made in the above constructions without departing from the scope of my invention, it is intended that all matter contained in the above description or shown in the accompanying drawing shall be interpreted as illustrative only, and not in a limiting sense.

It is also to be understood that the following claims are intended to cover all of the generic and specific features of my invention herein described, and all statements of the scope of my invention which, as a matter of language, may be said to fall therebetween.

What is claimed is:

1. A child's security tethering device consisting of:

a coiled elastically extensible linking member having opposite first and second end portions;

a first wristlet including a first band of woven fabric material having opposite first and second end portions and adapted to encircle a wrist of an adult, a first joining ring, said linking member first end portion coextending a distance with a portion of said first joining ring, said first joining ring and said linking member being permanently and directly secured to said first band so that said first band first end portion encircles the coextensive portions of said first joining ring and said linking member first end portion, and first hook and pile fastening means on said first band operable for securing said first wristlet on said wrist of an adult so that said first band encircles the latter and the second end portion of said first band extends through said first joining ring and back in overlying relation on the adjacent portion of said first band and so that substantially the entire outer surface of said first wristlet has a fabric-like appearance; and a second wristlet including a second band of woven fabric material having opposite first and second end portions and adapted to encircle a wrist of a small child, a second joining ring, said linking member second end portion coextending a distance with a portion of said second joining ring, said second joining ring and said linking member being permanently and directly secured to said second band so that said second band first end portion encircles the coextensive portions of said second joining ring and said linking member second end portion, second hook and pile fastening means on said second band operable for securing said second wristlet on said wrist of an adult so that said second band encircles the latter and the second end portion of said second band extends through said second joining ring and back in overlying relation on the adjacent portion of said second band, and so that substantially the entire outer surface of said second wristlet has a fabric-like appearance, and a retainer loop spanning the width of the outer side of said second band and operable for retaining said second band second end portion in overlying relation on said adjacent portion of said second band when said second band is secured on said wrist of a small child to retain said second hook and pile fastening means in an interengaged fastening position.

* * * * *